US009385409B2

(12) United States Patent
Ishizaki

(10) Patent No.: US 9,385,409 B2
(45) Date of Patent: Jul. 5, 2016

(54) MULTI-MODE RESONATOR/FILTER COMPRISED OF FIRST AND SECOND COLUMNAR CENTRAL CONDUCTORS DISPOSED WITHIN A CYLINDRICAL EXTERIOR CONDUCTOR

(71) Applicant: Toshio Ishizaki, Shiga (JP)

(72) Inventor: Toshio Ishizaki, Shiga (JP)

( * ) Notice: Subject to any disclaimer, the term of this patent is extended or adjusted under 35 U.S.C. 154(b) by 0 days.

(21) Appl. No.: 14/348,073

(22) PCT Filed: Sep. 29, 2012

(86) PCT No.: PCT/JP2012/075271
§ 371 (c)(1),
(2) Date: Mar. 28, 2014

(87) PCT Pub. No.: WO2013/047850
PCT Pub. Date: Apr. 4, 2013

(65) Prior Publication Data

US 2014/0232487 A1 Aug. 21, 2014

(30) Foreign Application Priority Data

Sep. 30, 2011 (JP) ..... 2011-218418
Aug. 27, 2012 (JP) ..... 2012-187082

(51) Int. Cl.
*H01P 1/205* (2006.01)
*H01P 1/208* (2006.01)
(Continued)

(52) U.S. Cl.
CPC ..... *H01P 1/2053* (2013.01); *H01P 1/20* (2013.01); *H01P 1/2082* (2013.01); *H01P 7/04* (2013.01); *H01P 7/06* (2013.01)

(58) Field of Classification Search
CPC ..... H01P 1/205; H01P 1/2053; H01P 1/208; H01P 1/2082
USPC ..... 333/203, 222
See application file for complete search history.

(56) References Cited

U.S. PATENT DOCUMENTS 6,549,092 B1 * 4/2003 Hattori ..... H01P 7/04 333/134
2009/0256651 A1 * 10/2009 Salehi ..... H01P 1/2082 333/202
2010/0188171 A1 * 7/2010 Mohajer-Iravani ... H01P 1/2005 333/175

FOREIGN PATENT DOCUMENTS

JP 2001-085908 A 3/2001
JP 2004-064577 A 2/2004
JP 2009-267702 A 11/2009

OTHER PUBLICATIONS

Official Communication issued in International Patent Application No. PCT/JP2012/075271, mailed on Dec. 18, 2012.

*Primary Examiner* — Benny Lee
(74) *Attorney, Agent, or Firm* — Keating & Bennett, LLP

(57) ABSTRACT

Provided is a multi-mode resonator in which four resonance modes are degenerated, a dielectric member is not necessarily required, and enhanced efficient use of space is obtained. A multi-mode resonator 1 is a multi-mode resonator in which four resonance modes are degenerated, this resonator including an exterior conductor 2 made of a metal material, and formed in the shape of a box, wherein both ends of a cylindrical circumferential wall section 2*c* are closed off by a first end section 2*a* and a second end section 2*b*; a columnar first central conductor disposed inside the exterior conductor 2, one end 3*a* being shorted to the first end section 2*a* of the exterior conductor 2 and another end 3*b* being left open; and a columnar second central conductor disposed inside the exterior conductor 2, one end 4*a* being shorted to the second end section 2*b* of the exterior conductor 2 and another end 4*b* being left open.

11 Claims, 15 Drawing Sheets

(51) Int. Cl.

| | |
|---|---|
| ***H01P 7/04*** | (2006.01) |
| ***H01P 7/06*** | (2006.01) |
| ***H01P 1/20*** | (2006.01) |

MULTI-MODE RESONATOR/FILTER COMPRISED OF FIRST AND SECOND COLUMNAR CENTRAL CONDUCTORS DISPOSED WITHIN A CYLINDRICAL EXTERIOR CONDUCTOR

TECHNICAL FIELD

The present invention relates to a multi-mode resonator in which a plurality of resonance modes are degenerated, and to a multi-mode filter using the multi-mode resonator, and a wireless communication device using the multi-mode filter.

BACKGROUND ART

In recent years, wireless communication devices which perform wireless communications by a high-frequency signal, such as microwave signals, are being used in many locations, such a cellular phone base stations. In order to receive electromagnetic waves of a band centered on a desired resonance frequency, these wireless communication devices incorporate a high-frequency filter composed by coupling a plurality of resonators which resonate at the resonance frequency in series. If the high-frequency filter is composed of N stages, then typically, N resonators which each resonate in one mode are coupled in succession. On the other hand, it has also been proposed to use a multi-mode resonator in which a plurality of resonant modes are degenerated by setting substantially the same resonance frequency, in such a manner that a high-frequency filter can be composed by a smaller number of resonators than N, and can be made compact in size.

For example, Patent Document 1 describes a multi-mode resonator in which four resonance modes degenerated. FIGS. 18A, 18B, 19A, 19B, 20A, 20B, 21A, 21B show the composition and electric field distribution of a multi-mode resonator 101 that is substantially the same as that described in Patent Document 1. In FIGS. 18A, 18B, 19A, 19B, 20A, 20B, 21A, 21B, the portion of the exterior conductor 102 in front of the internal members is depicted transparently so as to show the internal members. Furthermore, the electric field is indicated by the solid arrow lines. The magnetic field is not illustrated, but is distributed so as to circle around the electric field.

In this multi-mode resonator 101, a dielectric core 105 having a high permittivity of a special shape (an approximately octagonal columnar shape) is provided inside a box-shaped exterior conductor (cavity) 102. An electromagnetic field having a shorter wavelength due to the wavelength shortening effect of the high permittivity is localized and resonates in the dielectric core 105. Here, three resonance modes, namely, two TM modes (TM01δx mode and TM01δy mode) and one TE mode (TE01δ mode) degenerate. The two TM modes are modes where the electric field runs respectively in the X axis direction and the Y axis direction, and the electromagnetic field resonates with a half wavelength, as shown in FIGS. 18A, 18B, 19A, 19B. As shown in FIGS. 20A and 20B, the TE mode is a mode where the electric field runs in a circumferential direction about the central axis of the dielectric core 105, and the electromagnetic field resonates with a wavelength of one.

Moreover, in order to increment the number of resonance modes by one, a columnar central conductor 103 of which one end is shorted to an exterior conductor 102 is added so as to be inserted through a central hole formed in the central axis of the dielectric core 105. By means of this composition, a resonance mode of a so-called semi-coaxial resonator is obtained. As shown in FIGS. 21A and 21B, the resonance mode of a semi-coaxial resonator is a TEM mode in which the electric field runs radially from the central conductor 103 to the exterior conductor 102, and the electromagnetic field is distributed along the central conductor 103 and resonates with a quarter wavelength. The resonance frequency in this TEM mode is aligned with the resonance frequency of the two TM modes and the TE mode described above, by altering the outer diameter of the central conductor 103, for example, in such a manner that the distance of the gap from the central conductor 103 to the exterior conductor 102 is shorter on the side of the shorting terminal 103*a* compared to the open end 103*b* of the central conductor 103.

PRIOR ART DOCUMENTS

Patent Documents

Patent Document 1: Japanese Patent Application Publication No. 2004-349981

SUMMARY OF THE INVENTION

Problem to be Solved by the Invention

In this way, in Patent Document 1, is possible that four resonance modes are degenerated, by means of the composition of the multi-mode resonator 101. However, in this multi-mode resonator 101, the dielectric core 105 is an essential member which acts as a dielectric resonator, and the cost of making a dielectric core 105 having desired characteristics is extremely high. Furthermore, in the multi-mode resonator 101, the TEM mode and the other modes do not share the electromagnetic field in many places, and therefore the usage efficiency of the space occupied by the multi-mode resonator 101 cannot be high.

The present invention has been made in view of these reasons, an object thereof being to provide a multi-mode resonator in which at least three resonance modes are degenerated, in which a dielectric member isn't absolutely necessary, and in which the usage efficiency of the space occupied is high, and to provide a multi-mode filter which is a high-frequency filter using the multi-mode resonator, and a low-cost compact wireless communication device using the multi-mode filter.

Means for Solving the Problem

In order to achieve the abovementioned object, the multi-mode resonator relating to a preferred embodiment of the present invention is a multi-mode resonator in which at least three resonance modes are degenerated, including: a box-shaped exterior conductor in which both ends of a cylindrical circumferential wall section are closed off by a first end section and a second end section; and a columnar first central conductor disposed inside the exterior conductor, one end of the first central conductor being shorted to the first end section of the exterior conductor and the other end being left open.

Preferably, the three resonance modes are formed of: two TE modes that resonate at both end sections of the exterior conductor, with a half wavelength; and a TEM mode that resonates around the first central conductor, with a quarter wavelength.

Preferably, the multi-mode resonator further comprises a columnar second central conductor disposed inside the exterior conductor, one end of the second central conductor being shorted to the second end section of the exterior conductor, and the other end being left open; and at least four resonance modes are degenerated. In this case, preferably, one of the four resonance modes is a TEM mode which resonates around the second central conductor, with a quarter wavelength.

Preferably, the lengthwise-direction lengths of the first central conductor and the second central conductor are substantially the same.

Preferably, the first central conductor and the second central conductor are connected by a conductive thin lead wire. In this case, preferably, an inductance component of the lead wire constitutes a parallel resonance circuit with the capacitance between the first central conductor and the second central conductor, and the parallel resonance circuit resonates at the resonance frequency of the two TEM modes.

Preferably, a plurality of projections are formed in the inner wall of the circumferential wall section of the exterior conductor, the projections facing towards the center from the inner wall and extending in the lengthwise direction. In this case, preferably, four projections are formed.

Preferably, the internal space of the exterior conductor is filled with air or is formed by a dielectric body having high permittivity.

A multi-mode filter relating to a preferred embodiment of the present invention is composed on the basis of a composition using one of the multi-mode resonators, or multi-stage composition using a plurality of the multi-mode resonators.

The wireless communication device relating to a preferred embodiment of the present invention is incorporated with the multi-mode filter.

Effects of the Invention

According to the present invention, by providing an exterior conductor and a first central conductor having the composition described above, it is possible to provide a multi-mode resonator in which at least three resonance modes are degenerated, which makes a dielectric material such as a dielectric core not absolutely necessary, and which has a high usage efficiency of the occupied space, and furthermore, by also providing a second central conductor, it is possible to make at least four resonance modes degenerate. Moreover, by using this multi-mode resonator, it is possible to provide a multi-mode filter, and by using this multi-mode filter, it is possible to provide a low-cost wireless communication device of compact size.

BRIEF DESCRIPTION OF DRAWINGS

FIGS. 1A, 1B, 1C show a composition of a multi-mode resonator relating to an embodiment of the present invention, wherein FIG. 1A is a cross-sectional diagram in the lengthwise direction, FIG. 1B is a cross-sectional diagram perpendicular to the lengthwise direction at section line G-G, and FIG. 1C is a cross-sectional diagram perpendicular to the lengthwise direction at section line A-A (and section line B-B);

FIGS. 3A, 3B, 3C show a schematic view of the electric field distribution of one TE mode of the multi-mode resonator relating to the embodiment, wherein FIG. 3A is a cross-sectional diagram in the lengthwise direction, FIG. 3B is a cross-sectional diagram perpendicular to the lengthwise direction at section line G-G, and FIG. 3C is a cross-sectional diagram perpendicular to the lengthwise direction at section line A-A (and section line B-B);

FIGS. 4A, 4B, 4C show a schematic view of the electric field distribution of another TE mode of the multi-mode resonator described above, wherein FIG. 4A is a cross-sectional diagram in the lengthwise direction, FIG. 4B is a cross-sectional diagram perpendicular to the lengthwise direction at section line G-G, and FIG. 4C is a cross-sectional diagram perpendicular to the lengthwise direction at section line A-A (and section line B-B);

FIGS. 5A, 5B, 5C show a schematic view of the electric field distribution of one TEM mode of the multi-mode resonator described above, wherein FIG. 5A is a cross-sectional diagram in the lengthwise direction, FIG. 5B is a cross-sectional diagram perpendicular to the lengthwise direction at section line A-A, and FIG. 5C is a cross-sectional diagram perpendicular to the lengthwise direction at section line B-B;

FIGS. 6A, 6B, 6C show a schematic view of the electric field distribution of another TEM mode of the multi-mode resonator described above, wherein FIG. 6A is a cross-sectional diagram in the lengthwise direction, FIG. 6B is a cross-sectional diagram perpendicular to the lengthwise direction at section line A-A, and FIG. 6C is a cross-sectional diagram perpendicular to the lengthwise direction at section line B-B;

FIGS. 9A and 9B show a composition of a multi-mode resonator relating to yet a further embodiment of the present invention, wherein FIG. 9A is a cross-sectional diagram in the lengthwise direction, and FIG. 9B is a cross-sectional diagram perpendicular to the lengthwise direction at section line A-A (and section line B-B);

FIGS. 12A and 12B show a schematic view of the electric field distribution of one TE mode of the multi-mode resonator described above, wherein FIG. 12A is a cross-sectional diagram in the lengthwise direction, and FIG. 12B is a cross-sectional diagram perpendicular to the lengthwise direction at section line A-A (and section line B-B);

FIGS. 13A and 13B show a schematic view of the electric field distribution of another TE mode of the multi-mode resonator described above, wherein FIG. 13A is a cross-sectional diagram in the lengthwise direction, and FIG. 13B is a cross-sectional diagram perpendicular to the lengthwise direction at section line A-A (and section line B-B);

FIGS. 14A, 14B, 14C show a schematic view of the electric field distribution of one TEM mode of the multi-mode resonator described above, wherein FIG. 14A is a cross-sectional diagram in the lengthwise direction, FIG. 14B is a cross-sectional diagram perpendicular to the lengthwise direction at section line A-A, and FIG. 14C is a cross-sectional diagram perpendicular to the lengthwise direction at section line B-B;

FIGS. 15A, 15B, 15C show a schematic view of the electric field distribution of another TEM mode of the multi-mode resonator described above, wherein FIG. 15A is a cross-sectional diagram in the lengthwise direction, FIG. 15B is a cross-sectional diagram perpendicular to the lengthwise direction at section line A-A, and FIG. 15C is a cross-sectional diagram perpendicular to the lengthwise direction at section line B-B;

FIGS. 16A and 16B show results of a simulation relating to the multi-mode resonator described above, wherein FIG. 16A shows the dependence of the resonance frequency of the two TEM modes on the diameter of the lead wire, and FIG. 16B shows the dependence of the resonance frequencies of respective resonance modes on the height of the projections;

FIGS. 18A and 18B show the composition of a multi-mode resonator and the electric field distribution of one TM mode according to the prior art, wherein FIG. 18A is an external view in the lengthwise direction and FIG. 18B is an external view perpendicular to the lengthwise direction;

FIGS. 19A and 19B show the composition of a multi-mode resonator and the electric field distribution of another TM mode according to the prior art, wherein FIG. 19A is an external view in the lengthwise direction and FIG. 19B is an external view perpendicular to the lengthwise direction;

FIGS. 20A and 20B show the composition of a multi-mode resonator and the electric field distribution of a TE mode according to the prior art, wherein FIG. 20A is an external view in the lengthwise direction and FIG. 20B is an external view perpendicular to the lengthwise direction; and FIGS. 21A and 21B show the composition of a multi-mode resonator and the electric field distribution of a TEM mode according to the prior art, wherein FIG. 21A is an external view in the lengthwise direction and FIG. 21B is an external view perpendicular to the lengthwise direction.

DETAIL DESCRIPTION OF PREFERRED EMBODIMENTS

Figure 1A:
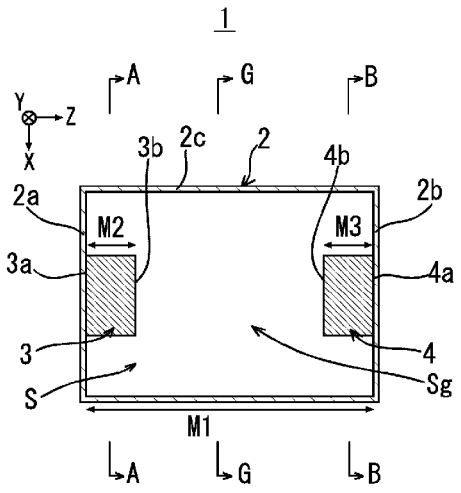
Figure 1B:
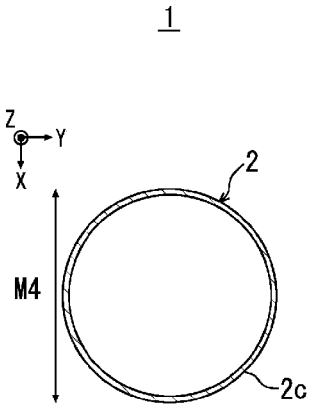
Figure 1C:
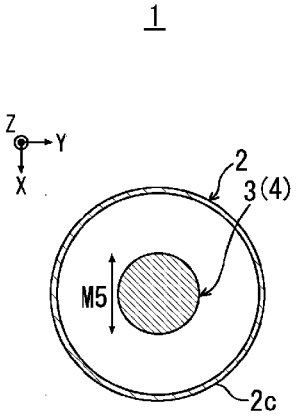

Hereinafter, preferred embodiments of the present invention will be described with reference to the drawings, where like features in different drawing figures are denoted by the same reference label. The multi-mode resonator 1 relating to the present embodiment is constituted by an exterior conductor 2, a first central conductor 3 and a second central conductor 4, as shown in FIGS. 1A, 1B, 1C. The multi-mode resonator 1 is used in a high-frequency region, such as a microwave region.

The exterior conductor 2 is made of a metal material, and is formed in the shape of a box, in which both ends of a cylindrical circumferential wall section 2*c* are closed off by a first end section 2*a* and a second end section 2*b*. In the present embodiment, the circumferential wall section 2*c* has a cylindrical shape.

The first central conductor 3 and the second central conductor 4 are made from metal and are disposed symmetrically inside the exterior conductor 2. One end 3*a* of the first central conductor 3 is shorted to the first end section 2*a* of the exterior conductor 2 and the other end 3*b* thereof is open. One end 4*a* of the second central conductor 4 is shorted to the second end section 2*b* of the exterior conductor 2 and the other end 4*b* thereof is open. Therefore, the other end 3*b* of the first central conductor 3 and the other end 4*b* of the second central conductor 4 are mutually facing via a gap Sg in the lengthwise direction having a prescribed distance. Normally, the first central conductor 3 and the second central conductor 4 are disposed in such a manner that the central axes thereof substantially coincide with each other and also substantially coincide with the central axis of the exterior conductor 2. Furthermore, in the present embodiment, the first central conductor 3 and the second central conductor 4 are formed in a columnar shape.

Figure 2:
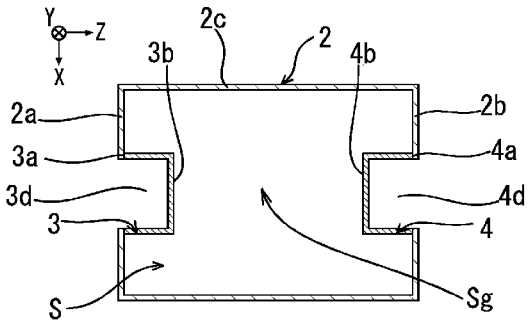
FIG. 2 is a cross-sectional diagram along the lengthwise direction showing a modification of the composition of the multi-mode resonator relating to the embodiment.

The first central conductor 3 and the second central conductor 4 may be columnar shapes having hollow sections 3*d*, 4*d*, in other words, a bottomed cylindrical shape. In this case, as shown in FIG. 2, only the other ends 3*b*, 4*b* have an end surface, and the one ends 3*a*, 4*a* may be left open towards the outside of the exterior conductor 2.

According to the composition described above, the multi-mode resonator 1 may have four resonance modes. Below, the specific resonance modes, namely, the two TE modes (first TE mode and second TE mode) and the two TEM modes (first TEM mode and second TEM mode) are described with reference to FIGS. 3A, 3B, 3C, 4A, 4B, 4C, 5A, 5B, 5C, 6A, 6B, 6C. The electromagnetic field is generated in the internal space S, which is the portion inside the exterior conductor 2, except the first central conductor 3 and the second central conductor 4, and in FIGS. 3A, 3B, 3C, 4A, 4B, 4C, 5A, 5B, 5C, 6A, 6B, 6C the electric field that generates in the internal space S is indicated by an arrow of a solid line. The magnetic field is not illustrated, but is distributed so as to circle around the electric field. Moreover, the lengthwise direction of the multi-mode resonator 1 is taken as the Z axis direction, a first direction which is perpendicular to the Z axis direction, as the X axis direction, and a second direction which is perpendicular to the Z axis direction and perpendicular to the first direction, as the Y axis direction.

Figure 3A:
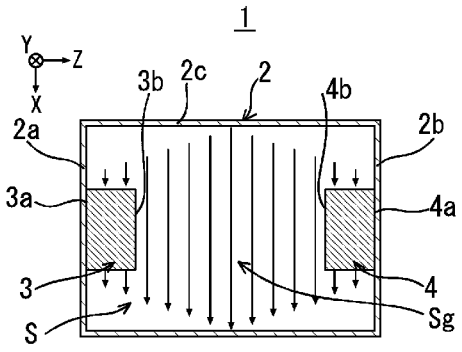
Figure 3B:
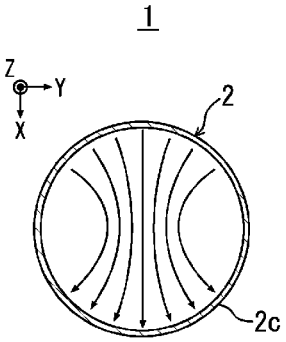
Figure 3C:
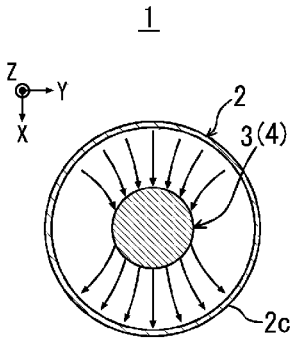

In the first TE mode, as shown in FIG. 3A, the electric field is distributed around a central field running in the first direction (X axis direction), and the electromagnetic field is distributed continuously between the two end sections 2*a*, 2*b* of the exterior conductor 2, and resonates with a half wavelength between the two end sections 2*a*, 2*b*. More specifically, as shown in FIG. 3B, in the first TE mode, in the cross-section G-G in the central portion of the gap Sg between the first central conductor 3 and the second central conductor 4, the electric field traverses in the X axis direction between opposing portions of the circumferential wall section 2*c* of the exterior conductor 2. This electric field is substantially the same as a so-called TE 111 mode, in which the electric field runs in the X axis direction of a cylindrical cavity resonator (a resonator in which the first central conductor 3 and the second central conductor 4 are not provided). Then, continuously with this electric field, an electric field that is substantially similar to the electric field in cross-section G-G is generated around the first central conductor 3 in the cross-section A-A at the Z axis position where the first central conductor 3 is present and around the second central conductor 4 in the cross-section B-B at the Z axis position where the second central conductor 4 is present.

Figure 4A:
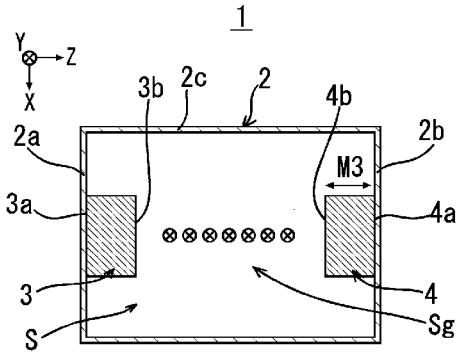
Figure 4B:
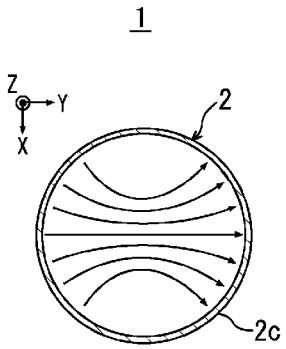
Figure 4C:
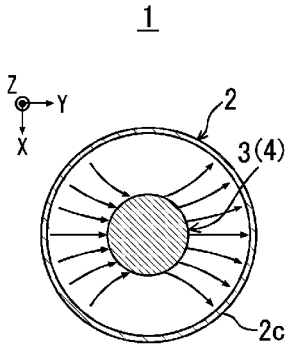

In the second TE mode, as shown in FIG. 4A, the electric field is distributed around a central field running in the second direction (Y axis direction), and the electromagnetic field is distributed continuously between the two end sections 2*a*, 2*b* of the exterior conductor 2, and resonates with a half wavelength between the two end sections 2*a*, 2*b*. More specifically, as shown in FIG. 4B, in the second TE mode, in the cross-section G-G in the central portion of the gap Sg between the first central conductor 3 and the second central conductor 4, the electric field traverses in the Y axis direction between opposing portions of the circumferential wall section 2*c* of the exterior conductor 2. This electric field is substantially the same as the so-called TE 111 mode in which an electric field runs in the Y axis direction in a cylindrical cavity resonator. Then, continuously with this electric field, an electric field that is substantially similar to the electric field in cross-section G-G is generated around the first central conductor 3 in the cross-section A-A at the Z axis position where the first central conductor 3 is present and around the second central conductor 4 in the cross-section B-B at the Z axis position where the second central conductor 4 is present.

As shown in FIGS. 5A, 5B, 5C, 6A, 6B, 6C, the first TEM mode and the second TEM mode are TEM modes in which the electric field runs radially between the first central conductor 3 and the circumferential wall section 2*c* of the exterior conductor 2, and between the second central conductor and the circumferential wall section 2*c* of the exterior conductor 2. In the first TEM mode and the second TEM mode, the electromagnetic field is distributed continuously between a position at one end 3*a* of the first central conductor 3 (the position of the first end section 2*a* of the exterior conductor 2) and a position at the other end 3*b* of the first central conductor 3, and resonates with a quarter wavelength around the first central conductor 3. The electric field becomes a maximum in the vicinity of the position of the other end 3*b* of the first central conductor 3 and the magnetic field becomes a maximum in the vicinity of the one end 3*a* of the first central conductor 3. In the first TEM mode and the second TEM mode, the electromagnetic field is distributed continuously between a position at the one end 4*a* of the second central conductor 4 (the position of the second end section 2*b* of the exterior conductor 2) and a position at the other end 4*b* of the second central conductor 4, and resonates with a quarter wavelength around the second central conductor 4. The electric field becomes a maximum in the vicinity of the position of the other end 4*b* of the second central conductor 4 and the magnetic field becomes a maximum in the vicinity of the one end 4*a* of the second central conductor 4.

Figure 5A:
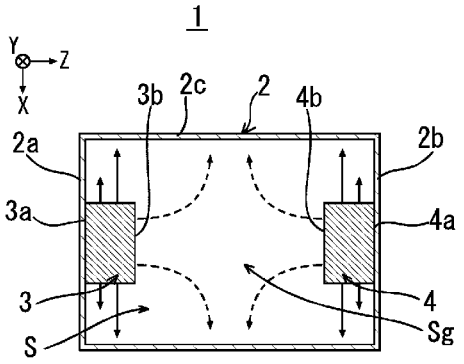
Figure 5B:
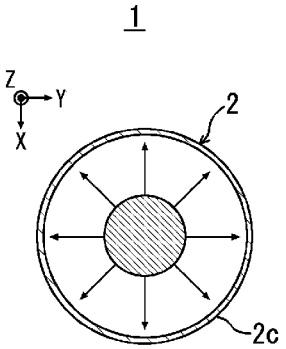
Figure 5C:
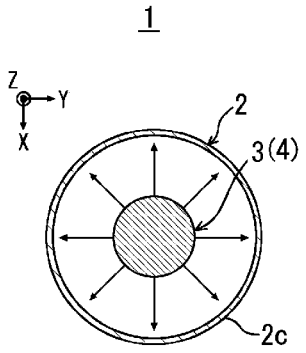
Figure 6A:
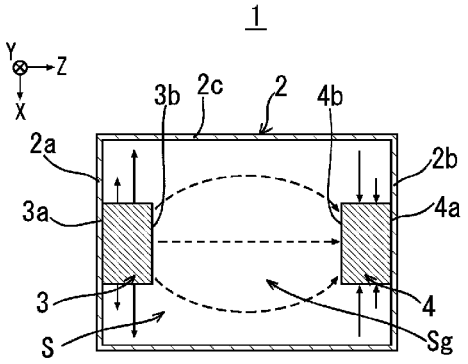
Figure 6B:
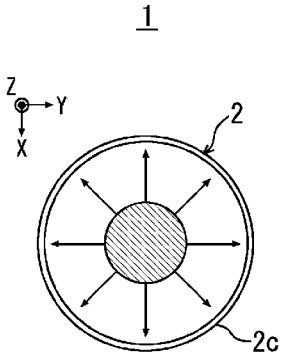
Figure 6C:
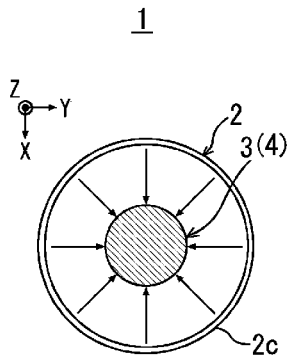

The first TEM mode is a mode in which the direction of the electric field between the first central conductor 3 and the circumferential wall section 2*c* of the exterior conductor 2, and the direction of the electric field between the second central conductor 4 and the circumferential wall section 2*c* of the exterior conductor 2, are the same direction. The second TEM mode is a mode in which the direction of the electric field between the first central conductor 3 and the circumferential wall section 2*c* of the exterior conductor 2, and the direction of the electric field between the second central conductor 4 and the circumferential wall section 2*c* of the exterior conductor 2, are opposite directions. The electromagnetic field around the first central conductor 3 and the electromagnetic field around the second central conductor 4 interfere with each other in accordance with the distance of the gap Sg between the first central conductor 3 and the second central conductor 4, and the resonance frequencies of the first TEM mode and the second TEM mode is affected by this interference, albeit slightly. In FIGS. 5A and 6A, the electric field generated in the gap Sg between the first central conductor 3 and the second central conductor 4 is indicated by a dotted line.

In this way, the resonance frequencies of the four resonance modes are: in the first TE mode and the second TE mode, a frequency whereby the length M1 (FIG. 1A) between the two end sections 2*a*, 2*b* of the exterior conductor 2 is approximately equal to a half wavelength, and, in the first TEM mode and the second TEM mode, a frequency whereby the length M2 (FIG. 1A) of the first central conductor 3 and the length M3 (FIG. 1A) of the second central conductor 4 is approximately equal to a quarter wavelength. Furthermore, since the wavelength in the first TE mode and the second TE mode is approximately the same as the guided wavelength of a cylindrical cavity resonator, then at the same frequency, this wavelength is in principle longer than the wavelength of the first TEM mode and the second TEM mode. The wavelength of the first TE mode and the second TE mode can be adjusted by the diameter M4 (FIG. 1B) of the circumferential wall section 2*c* of the exterior conductor 2. Therefore, basically, by determining the length M2 of the first central conductor 3 and the length M3 of the second central conductor 4, and determining the length M1 between the two end sections 2*a*, 2*b* of the exterior conductor 2, and the diameter M4 of the circumferential wall section 2*c*, in accordance with the value of the resonance frequency, then it is possible to make four resonance modes degenerate with substantially the same resonance frequency.

Furthermore, since the plurality of resonance modes share the electromagnetic field at any location in the internal space S (FIGS. 3A, 4A, 5A, 6A), then in this respect, the usage efficiency of the space occupied by the multi-mode resonator 1 is high. Moreover, a dielectric member such as that indicated in the prior art described above is not absolutely necessary.

It is possible to install input and output terminals, and a frequency adjusting member, and the like (not shown in the drawings), at suitable positions in the exterior conductor 2. The input/output terminals are coupled to the multi-mode resonator 1 and serve to input and output signals; for example, electrodes coupled to the first central conductor 3 or the second central conductor 4 are connected on the inner side. The frequency adjusting member adjusts the frequency of the respective resonance modes. The input/output terminals and frequency adjusting member can use various commonly known technologies, as appropriate.

Figure 7:
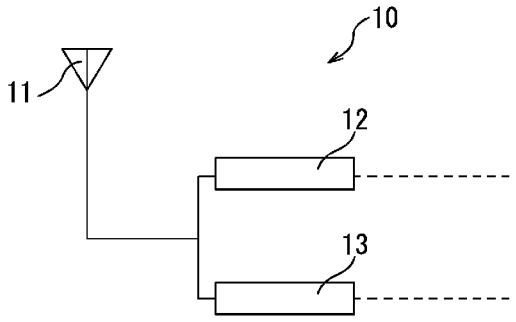
FIG. 7 is a block diagram showing an example of a wireless communication device.

The multi-mode resonator 1 in which four resonance modes are degenerated in this way can be used as a multi-mode filter (not shown in the drawings) by mutually coupling the resonance modes. In this case, it is possible to couple the modes by installing a commonly known coupling adjustment member (not shown in the drawings), such as a coupling adjustment screw, at an appropriate location on the exterior conductor 2, so as to make the electromagnetic field distribution asymmetrical and create a perturbation. This multi-mode filer may be composed using a single multi-mode resonator 1, or may have a multi-stage composition using a plurality of multi-mode resonators 1, depending on the desired characteristics. Furthermore, by incorporating this multi-mode filter, it is possible to make a wireless communication device compact in size, at low cost. For example, as shown in FIG. 7, a duplexer 10 of a wireless communication device, such as a cellular phone base station, can be made compact in size, at very low cost, if the transmission filter 12 and the reception filter 13 which are connected to the antenna 11 are composed as multi-mode filters having different resonance frequencies.

The results of a simulation carried out by the present inventor in relation to the multi-mode resonator 1 are indicated below in Table 1. The length M1 (FIG. 1A) between the two end sections 2*a*, 2*b* of the exterior conductor 2 was 167.6 mm, the length M2 (FIG. 1A) of the first central conductor 3 and the length M3 (FIG. 1A) of the second central conductor 4 were both 15 mm, and the diameter M4 (FIG. 1B) of the circumferential wall section 2*c* of the exterior conductor 2 was 100 mm. Furthermore, the diameter M5 (FIG. 1C) of the first central conductor 3 and the second central conductor 4 was 50 mm. As a result of this, the resonance frequency was 2.02 GHz in the first TE mode and the second TE mode, 2.04 GHz in the first TEM mode, and 2.00 GHz in the second TEM mode. Consequently, four resonance modes degenerate in the multi-mode resonator 1, and by mutually coupling these modes, the multi-mode resonator 1 can be used as a multi-mode filter.

TABLE 1

| Resonance mode | Resonance frequency (GHz) |
|---|---|
| First TEM mode | 2.04 |
| Second TEM mode | 2.00 |
| First TE mode | 2.02 |
| Second TE mode | 2.02 |

Figure 8:
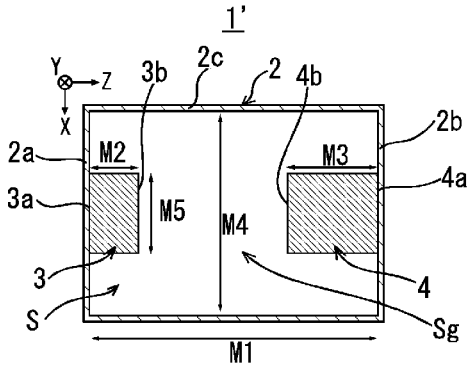
FIG. 8 is a cross-sectional diagram in the lengthwise direction showing a multi-mode resonator relating to a further embodiment of the present invention.

Next, the multi-mode resonator 1' relating to a further embodiment of the invention will be described. This multi-mode resonator 1' is modified from the multi-mode resonator 1 and makes three resonance modes degenerate. As shown in FIG. 8, in the multi-mode resonator 1', the length M2 (FIG. 8) of the first central conductor 3 and the length M3 (FIG. 8) of the second central conductor 4 in the multi-mode resonator 1 are made different, and only one TEM mode resonance mode is made degenerate, while the resonance frequency of the other TEM mode resonance mode is separate and is not made degenerate. Therefore, three resonance modes degenerate in the multi-mode resonator 1'.

The results of a simulation carried out by the present inventor in relation to the multi-mode resonator 1' are indicated below in Table 2. The length M1 (FIG. 8) between the two end sections 2*a*, 2*b* of the exterior conductor 2 was 88 mm, the length M2 (FIG. 8) of the first central conductor 3 was 16.2 mm, the length M3 (FIG. 8) of the second central conductor 4 was 37.5 mm, and the diameter M4 (FIG. 8) of the circumferential wall section 2*c* of the exterior conductor 2 was 120 mm. Furthermore, the diameter M5 (FIG. 8) of the first central conductor 3 and the second central conductor 4 was 64 mm. As a result of this, the resonance frequency was 2.00 GHz in each of the first TE mode, the second TE mode and the first TEM mode. Consequently, three resonance modes degenerate in the multi-mode resonator 1', and by mutually coupling these modes, the multi-mode resonator 1' can be used as a multi-mode filter. The resonance frequency of the second TEM mode was 1.15 GHz.

TABLE 2

| Resonance mode | Resonance frequency (GHz) |
|---|---|
| First TEM mode | 2.00 |
| Second TEM mode | 1.15 |
| First TE mode | 2.00 |
| Second TE mode | 2.00 |

Furthermore, if three resonance modes are made degenerate, then depending on circumstances, it is possible to omit one of the first central conductor 3 and the second central conductor 4.

Figure 9A:
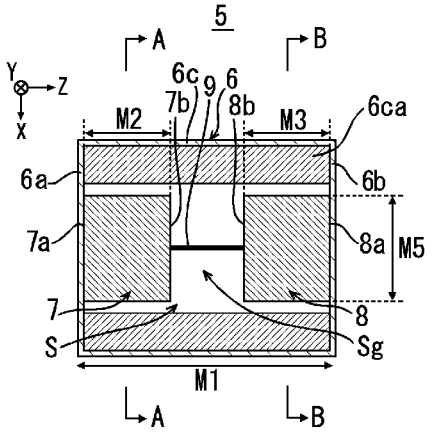
Figure 9B:
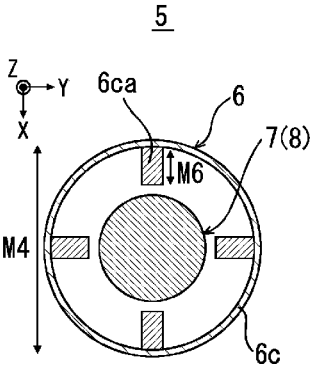

Next, the multi-mode resonator 5 relating to yet a further embodiment of the invention will be described. This multi-mode resonator 5 is modified from the multi-mode resonator 1 and makes at least four resonance modes degenerate. As shown in FIGS. 9A and 9B, the multi-mode resonator 5 is constituted by an exterior conductor 6, a first central conductor 7 and a second central conductor 8.

Similarly to the exterior conductor 2 described above, the exterior conductor 6 is made of a metal material, and is formed in the shape of a box, in which both ends of a cylindrical circumferential wall section 6*c* are closed off by a first end section 6*a* and a second end section 6*b* as shown in FIG. 9A. In the present embodiment, the circumferential wall section 6*c* has a cylindrical shape.

A plurality of projections 6*ca* facing towards the center and extending in the lengthwise direction are formed on the inner wall of the circumferential wall section 6*c* of the exterior conductor 6. The radial-direction length of the projections 6*ca* facing towards the center (the height of the projections 6*ca*) (value M6 in FIG. 9B) is a length having a prescribed gap between the front end of the projection 6*ca* and the first central conductor 7 or the second central conductor 8. In order for the projections 6*ca* to display beneficial effects, normally, the length of the gap is preferred to be no more than one fifth of the length of the gap Sg between the first central conductor and second central conductor described below.

Figure 10:
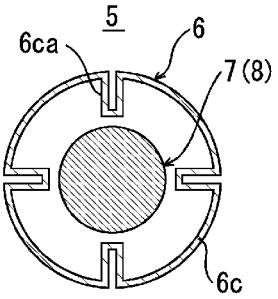
FIG. 10 is a cross-sectional diagram perpendicular to the lengthwise direction at the section line A-A (and section line B-B) showing a modification of the composition of the multi-mode resonator described above.

Four projections 6*ca* are formed at equidistant intervals in the circumferential direction as depicted in FIG. 9B. Depending on the circumstances, an even number of projections greater than four may be formed. The cross-section of the projections 6*ca* may be a rectangular shape or a trapezoid shape. As shown in FIGS. 9A and 9B, the projections 6*ca* may be integrated by combining a plate-shaped member made of a metal material on the inner wall of the cylindrical circumferential wall section 6*c*, or may be formed by creating inward depressions in the exterior conductor 6, as shown in FIG. 10.

The first central conductor 7 and the second central conductor 8 are each made of a metal material and are disposed symmetrically inside the exterior conductor 6 as shown in FIG. 9A, similarly to the first central conductor 3 and the second central conductor 4 described above. One end 7*a* of the first central conductor 7 is shorted to the first end section 6*a* of the exterior conductor 6 and the other end 7*b* thereof is open as shown in FIG. 9A. One end 8*a* of the second central conductor 8 is shorted to the second end section 6*b* of the exterior conductor 6 and the other end 8*b* thereof is open as shown in FIG. 9A. Therefore, the other end 7*b* of the first central conductor 7 and the other end 8*b* of the second central conductor 8 face each other via a gap Sg in the lengthwise direction having a prescribed distance. The lengthwise-direction lengths of the first central conductor 7 and the second central conductor 8 (M2 and M3 in FIG. 9A) are substantially the same. Furthermore, normally, the first central conductor 7 and the second central conductor 8 are disposed in such a manner that the central axes thereof substantially coincide with each other and also substantially coincide with the central axis of the exterior conductor 6. Furthermore, in the present embodiment, the first central conductor 7 and the second central conductor 8 are formed in a columnar shape.

Figure 11:
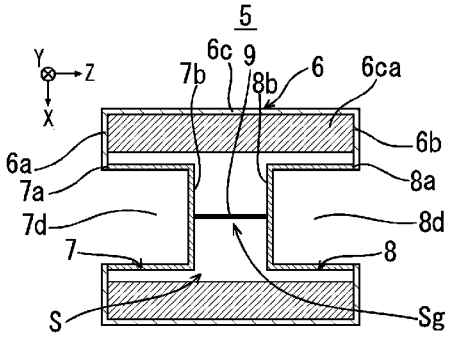
FIG. 11 is a cross-sectional diagram along the lengthwise direction showing a further modification of the composition of the multi-mode resonator described above.

The first central conductor 7 and the second central conductor 8 may be columnar shapes having hollow sections 7*d*, 8*d*, in other words, a bottomed cylindrical shape. In this case, as shown in FIG. 11, only the other ends 7*b*, 8*b* have an end surface, and the one ends 7*a*, 8*a* may be left open towards the outside of the exterior conductor 6.

The first central conductor 7 and the second central conductor 8 are connected to each other by a thin conductive lead wire 9.

According to the composition described above, the multi-mode resonator 5 can have four resonance modes. Below, the specific resonance modes, namely, the two TE modes (first TE mode and second TE mode) and the two TEM modes (first TEM mode and second TEM mode) are described with reference to FIGS. 12A, 12B, 13A, 13B, 14A, 14B, 14C, 15A, 15B, 15C. The electromagnetic field is generated in the internal space S, which is the portion inside the exterior conductor 6, except the first central conductor 7 and the second central conductor 8, and in FIGS. 12A, 12B, 13A, 13B, 14A, 14B, 14C, 15A, 15B, 15C the electric field that generates in the internal space S is indicated by an arrow of a solid line. The magnetic field is not illustrated, but is distributed so as to circle around the electric field. Moreover, the lengthwise direction of the multi-mode resonator 5 is taken as the Z axis direction, a first direction which is perpendicular to the Z axis direction, as the X axis direction, and a second direction which is perpendicular to the Z axis direction and perpendicular to the first direction, as the Y axis direction.

Figure 12A:
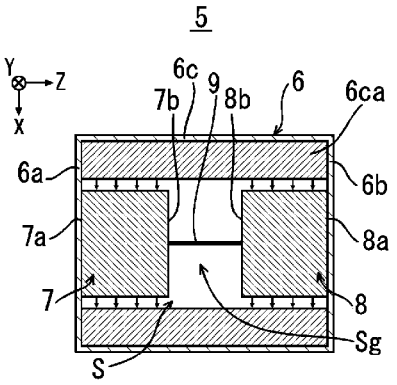
Figure 12B:
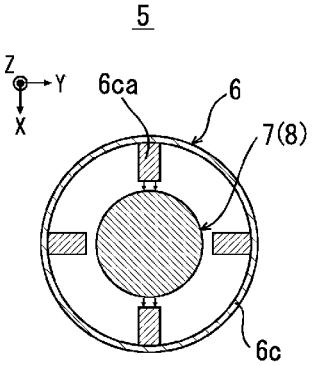
Figure 13A:
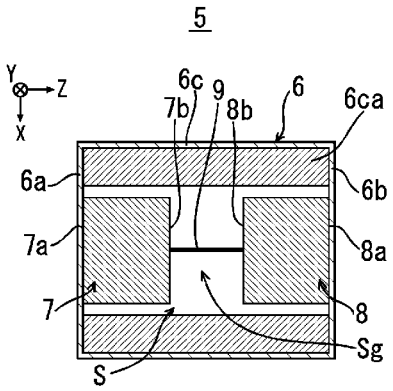
Figure 13B:
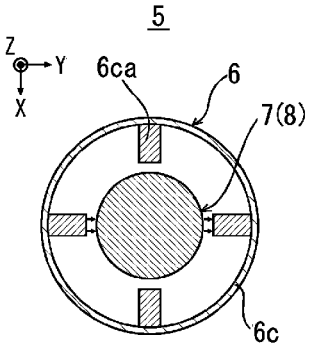
Figure 14A:
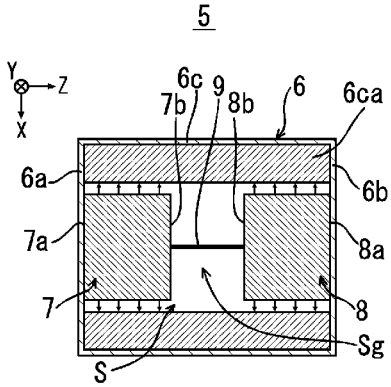
Figure 14B:
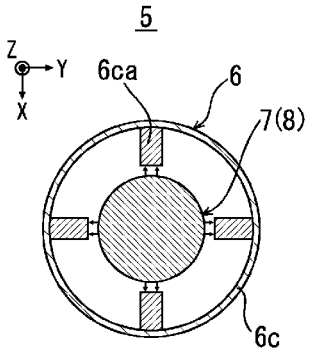
Figure 14C:
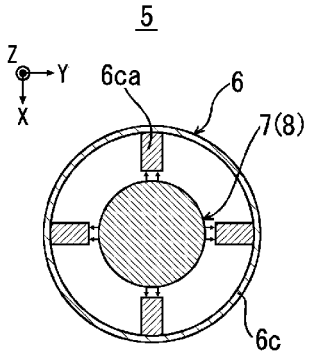
Figure 15A:
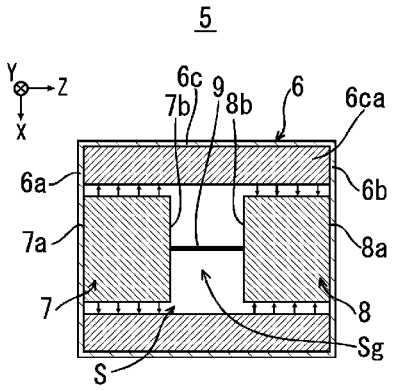
Figure 15B:
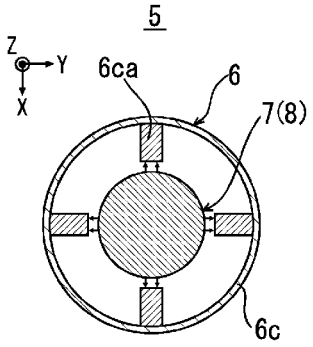
Figure 15C:
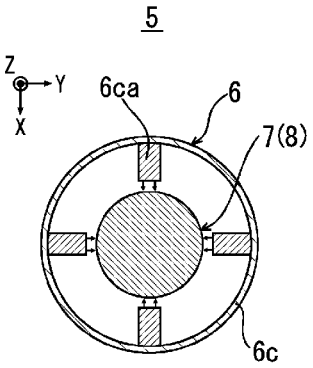

As shown in FIGS. 12A and 12B, the first TE mode is a mode in which the electric field is distributed about a central field running between the front end of the projection 6*ca* and the first central conductor 7 or the second central conductor 8, in the first direction (X axis direction) (FIG. 12B), and the electromagnetic field resonates with a half wavelength, between the end sections 6*a*, 6*b* (FIG. 12A) of the exterior conductor 6. As shown in FIGS. 13A and 13B, the second TE mode is a mode in which the electric field is distributed about a central field running between the front end of the projection 6*ca* and the first central conductor 7 or the second central conductor 8, in the second direction (Y axis direction) (FIG. 13B), and the electromagnetic field resonates with a half wavelength, between the end sections 6*a*, 6*b* (FIG. 13A) of the exterior conductor 6. These two TE modes can be classified as so-called TE111 modes, in which the electric field runs in the X axis direction or the Y axis direction of the cylindrical cavity resonator constituted by the exterior conductor 6.

Furthermore, in these two TE modes, the electric field generated in the circumferential wall section 6*c* apart from the projections 6*ca* is either substantially zero, or very small indeed. Moreover, in these two TE modes, the electric field generated around the projections 6*ca* at the position of the gap Sg between the first central conductor 7 and the second central conductor 8 is either substantially zero, or very small indeed since the electric field is cancelled out by the lead wire 9 (described hereinafter).

As shown in FIGS. 14A, 14B, 14C, 15A, 15B, 15C, the first TEM mode and the second TEM mode are TEM modes in which the electric field runs radially between the first central conductor 7 and the circumferential wall section 6*c* of the exterior conductor 6, and between the second central conductor and the circumferential wall section 6*c* of the exterior conductor 6. In the first TEM mode and the second TEM mode, the electromagnetic field is distributed continuously between a position at one end 7*a* of the first central conductor 7 (the position of the first end section 6*a* of the exterior conductor 6) and a position at the other end 7*b* of the first central conductor 7, and resonates with a quarter wavelength around the first central conductor 7. The electric field becomes a maximum in the vicinity of the position of the other end 7*b* of the first central conductor 7 and the magnetic field becomes a maximum in the vicinity of the one end 7*a* of the first central conductor 7. Furthermore, in the first TEM mode and the second TEM mode, the electromagnetic field is distributed continuously between a position at the one end 8*a* of the second central conductor 8 (the position of the second end section 6*b* of the exterior conductor 6) and a position at the other end 8*b* of the second central conductor 8, and resonates with a quarter wavelength around the second central conductor 8. The electric field becomes a maximum in the vicinity of the position of the other end 8*b* of the second central conductor 8 and the magnetic field becomes a maximum in the vicinity of the one end 8*a* of the second central conductor 8. Furthermore, in these two TEM modes, the electric field generated in the circumferential wall section 6*c* apart from the projections 6*ca* is either substantially zero, or very small indeed.

The first TEM mode is a mode in which the direction of the electric field between the first central conductor 7 and the circumferential wall section 6*c* of the exterior conductor 6, and the direction of the electric field between the second central conductor 8 and the circumferential wall section 6*c* of the exterior conductor 6, are the same. The second TEM mode is a mode in which the direction of the electric field between the first central conductor 7 and the circumferential wall section 6*c* of the exterior conductor 6, and the direction of the electric field between the second central conductor 8 and the circumferential wall section 6*c* of the exterior conductor 6, are opposite to each other.

The first central conductor 7 and the second central conductor 8 which are mutually facing have greater capacitive coupling, when the distance of the gap Sg is relatively short. In this case, the electromagnetic field around the first central conductor 7 and the electromagnetic field around the second central conductor 8 interfere with each other in accordance with the distance of the gap Sg between the first central conductor 7 and the second central conductor 8, and the resonance frequencies of the first TEM mode and the second TEM mode is liable to be affected by this interference. This interference can be made extremely small by the lead wire 9, as described below.

Furthermore, the resonance frequencies of these four resonance modes are: in the first TE mode and the second TE mode, a frequency whereby the length M1 (FIG. 9A) between the two end sections 6*a*, 6*b* of the exterior conductor 6 is approximately equal to a half wavelength, and, in the first TEM mode and the second TEM mode, a frequency whereby the length M2 (FIG. 9A) of the first central conductor 7 and the length M3 (FIG. 9A) of the second central conductor 8 is approximately equal to a quarter wavelength. Furthermore, since the wavelength of the first TE mode and the second TE mode is approximately the same as the guided wavelength of the cylindrical cavity resonator, then at the same frequency, this wavelength is in principle longer than the wavelength of the first TEM mode and the second TEM mode. Therefore, normally, the resonance frequencies of the first TE mode and the second TE mode are higher than the resonance frequencies of the first TEM mode and the second TEM mode. The resonance frequencies of the first TE mode and the second TE mode, and the resonance frequencies of the first TEM mode and the second TEM mode can be made to approach each other by the projections 6*ca*, as described below.

In the multi-mode resonator 5 of this kind, similarly to the multi-mode resonator 1 described above, since the plurality of resonance modes share the electromagnetic field at any location in the internal space S, then in this respect, the usage efficiency of the space occupied by the multi-mode resonator 5 is high and a dielectric member such as that indicated in the prior art described above is not absolutely necessary.

Next, the action of the lead wire 9 and the projections 6*ca* on the exterior conductor 6 will be described in detail with reference to the results of a simulation carried out by the present inventor. The lead wire 9 and the projections 6*ca* cause the resonance frequencies of the four resonance modes to be substantially matching, and facilitate multi-mode operation in which four resonance modes are degenerated.

With regard to the simulation conditions, the length M1 (FIG. 9A) between the two end sections 6*a*, 6*b* of the exterior conductor 6 was 112 mm, the length M2 (FIG. 9A) of the first central conductor 7 and the length M3 (FIG. 9A) of the second central conductor 8 was 37.5 mm, and the diameter M4 (FIG. 9B) of the circumferential wall section 6*c* of the exterior conductor 6 was 100 mm. Furthermore, the diameter M5 (FIG. 9A) of the first central conductor 7 and the second central conductor 8 was 49 mm.

Firstly, the action of the lead wire 9 will be described. This lead wire 9 suppresses the phenomenon of splitting (separation) of the resonance frequencies of the first TEM mode and the second TEM mode, due to the effects of capacitive coupling between the first central conductor 7 and the second central conductor 8.

If the length of the lead wire 9 is expressed as a and the diameter thereof as b, then in approximate terms, the lead wire 9 has an inductance component having an inductance value L as expressed in Formula (1).

[Math. 1]

$$L = 2a \cdot \left(\log\left(\frac{4a}{b}\right) - \frac{3}{4}\right) \quad (1)$$

This inductance component constitutes a parallel resonance circuit with the capacitance between the first central conductor 7 and the second central conductor 8, and when this circuit resonates, the electric field coupling is cancelled out between the first central conductor 7 and the second central conductor 8, and the interference between the electromagnetic field around the first central conductor 7 and the electromagnetic field around the second central conductor becomes very small. Therefore, by setting the parallel resonance circuit to resonate at the resonance frequencies of the first TEM mode and the second TEM mode, it is possible to make the resonance frequencies of the first TEM mode and the second TEM mode substantially coincide with each other. The frequency at which the parallel resonance circuit resonates is adjusted by, for example, altering the diameter of the lead wire 9 to control the inductance value.

In this way, the effects of capacitive coupling between the first central conductor 7 and the second central conductor 8 can be cancelled out by the lead wire 9, and therefore it is possible to make the resonance frequencies of the first TEM mode and the second TEM mode substantially coincide with each other, and furthermore, the distance of the gap Sg between the first central conductor 7 and the second central conductor 8 can be shortened, for example, can be made shorter than the length of either the first central conductor or the second central conductor 8, as in the simulation conditions.

Figure 16A:
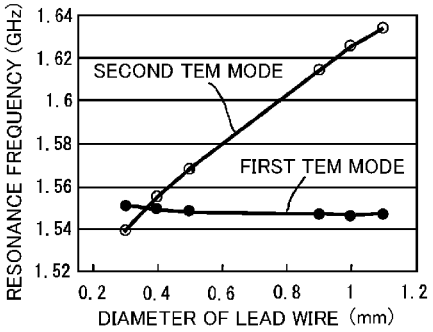

FIG. 16A shows simulation results depicting change in the resonance frequencies of the first TEM mode and the second TEM mode, when the diameter of the lead wire 9 is changed so as to alter the inductance value. According to FIG. 16A, the resonance frequency in GHz changes with the diameter of the lead wire 9 in mm, and it can be seen that when the diameter is approximately 0.4 mm, the resonance frequency of the first TEM mode and the resonance frequency of the second TEM mode coincide with each other. This simulation was carried out in a state where the projections 6*ca* are not provided.

Next, the action of the projections 6*ca* on the exterior conductor 6 will be described.

The projections 6*ca* lower the resonance frequencies of the first TE mode and the second TE mode that are higher than the resonance frequencies of the first TEM mode and the second TEM mode. This is because a capacitive coupling is formed between the projections 6*ca*, which are one portion of the exterior conductor 6, and the first central conductor 7 and between the projections 6*ca* and the second central conductor 8, and furthermore the equivalent circumferential length of the exterior conductor 6 becomes longer and the cut-off frequency falls. By lowering the resonance frequencies of the first TE mode and the second TE mode, it is possible to cause the resonance frequencies of the first TE mode and the second TE mode to approach the resonance frequencies of the first TEM mode and the second TEM mode.

Figure 16B:
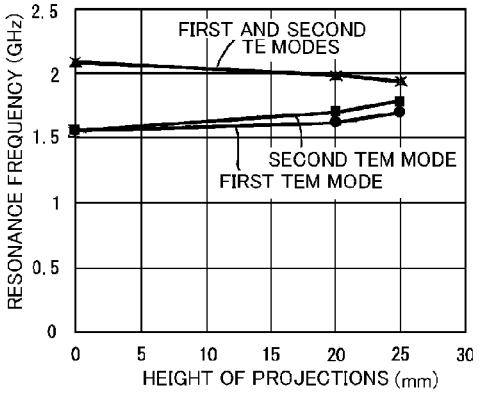

FIG. 16B shows simulation results depicting change in the resonance frequencies of the four resonance modes, when the height M6 (FIG. 9B) of the projections 6*ca* is altered. From FIG. 16B, it can be seen that, as the height M6 of the projections 6*ca* in mm increases, the resonance frequencies in GHz of the first TE mode and the second TE mode becomes lower. Furthermore, a tendency is also observed whereby the resonance frequencies of the first TEM mode and the second TEM mode rise, as the height M6 of the projections 6*ca* increases. In this simulation, the diameter of the lead wire 9 was 0.4 mm.

Next, Table 3 shows the results of a simulation wherein the resonance frequencies of four resonance modes substantially coincide with each other, due to the lead wire 9 and the projections 6*ca*. Here, the diameter of the lead wire 9 was 0.2 mm, and the height M6 (FIG. 9B) of the projection 6*ca* was 25 mm. A multi-mode resonator was possible in which the respective resonance frequencies of the first TEM mode, second TEM mode, first TE mode and second TE mode, substantially coincide with each other, and four resonance modes can be made degenerate.

TABLE 3

| Resonance mode | Resonance frequency (GHz) |
|---|---|
| First TEM mode | 1.9661 |
| Second TEM mode | 1.9815 |
| First TE mode | 2.0543 |
| Second TE mode | 2.0574 |

Furthermore, in a state where the resonance frequencies of the four resonance modes substantially coincide with each other, a third TE mode and a fourth TE mode appear with a resonance frequency in the vicinity of the resonance frequencies of these four resonance modes, as shown in Table 4. In the third TE mode, the electric field is distributed about a central field running in the first direction (X axis direction), and the direction of the electric field at the Z axis position where the first central conductor 7 is present and the direction of the electric field at the Z axis position where the second central conductor 8 is present are mutually opposite directions. In the fourth TE mode, the electric field is distributed about a central field running in the second direction (Y axis direction), and the direction of the electric field at the Z axis position where the first central conductor 7 is present and the direction of the electric field at the Z axis position where the second central conductor 8 is present are mutually opposite directions. The third TE mode and the fourth TE mode appear because the electric field tends to be cancelled out between the first central conductor 7 and the second central conductor 8 in the TE mode, due to the lead wire 9.

TABLE 4

| Resonance mode | Resonance frequency (GHz) |
|---|---|
| Third TE mode | 2.2533 |
| Fourth TE mode | 2.2569 |

In this simulation result, the resonance frequencies of the third TE mode and the fourth TE mode are slightly separated from the resonance frequency of the four resonance modes, but multi-mode operation is possible as a broad-band microwave filter, and if these modes are included, then a multi-mode resonator in which six resonance modes are degenerated can be achieved.

Moreover, although not described in detail here, as shown in Table 5, two resonance modes appear in the vicinity of these six resonance modes, the resonance frequency of these two modes appearing to be determined by the cross-sectional dimensions. These modes also enable multi-mode operation as a broad-band microwave filter and by including these modes, a multi-mode resonator in which eight resonance modes are degenerated can be achieved.

TABLE 5

| Resonance mode | Resonance frequency (GHz) |
|---|---|
| — | 2.1503 |
| — | 2.4278 |

The multi-mode resonator 5 has been described above. The lead wire 9 and the projections 6*ca* cause the resonance frequencies of at least the four resonance modes to substantially coincide with each other, and multi-mode operation in which these resonance modes are degenerated can be achieved easily, but depending on the circumstances, it is also possible to use another means, or to combine the use of another means.

While the multi-mode resonators according to the embodiments of the present invention have been described, the present invention can be changed in design in various ways within the scope described in the claims without being limited to those described in the embodiments. For example, the exterior conductor 2 of the multi-mode resonator 1 is not limited to being a cylindrical shape and may be a square cylindrical shape, and furthermore, the first central conductor 3 and the second central conductor 4 are not limited to being a columnar shape, and may also adopt a square pillar shape, or a stepped shape of superimposed columns having different diameters. The same also applies to the multi-mode resonator 1' and the multi-mode resonator 5.

Figure 17:
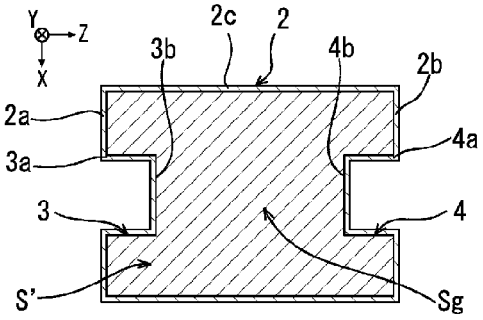
FIG. 17 is a cross-sectional diagram in the lengthwise direction showing a further modification of the composition of the multi-mode resonator relating to an embodiment of the present invention.
Figure 18A:
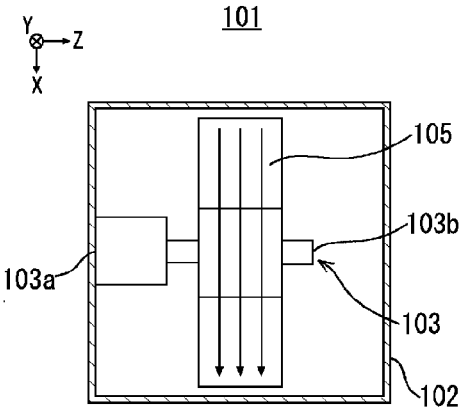
Fig. 18A Prior Art
Figure 18B:
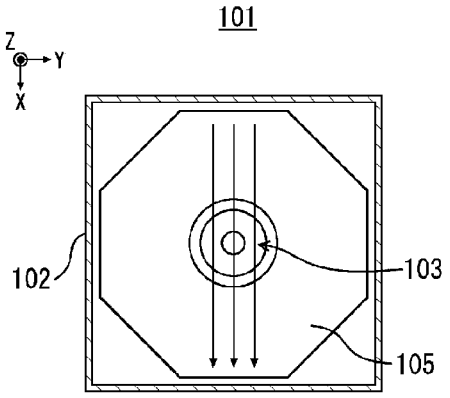
Fig. 18B Prior Art
Figure 19A:
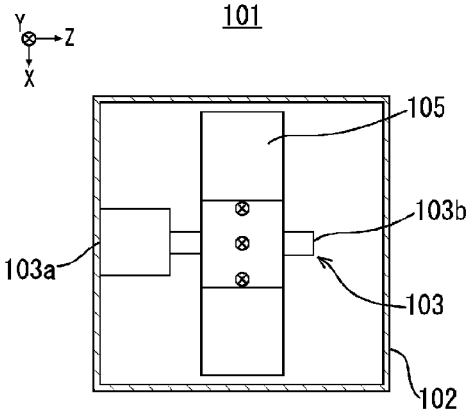
Fig. 19A Prior Art
Figure 19B:
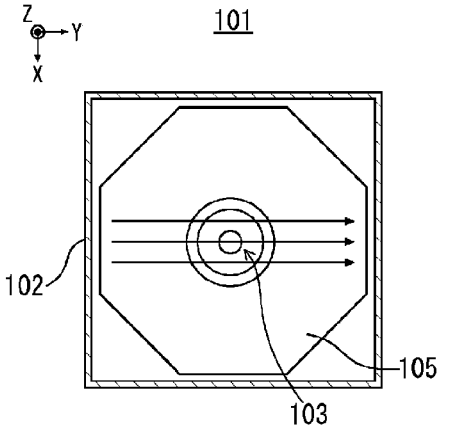
Fig. 19B Prior Art
Figure 20A:
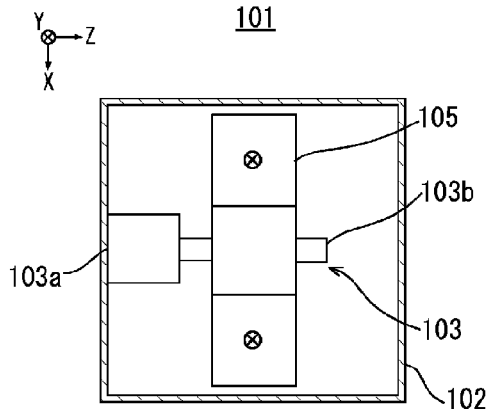
Fig. 20A Prior Art
Figure 20B:
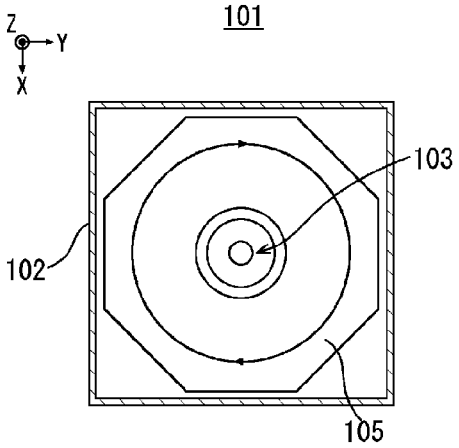
Fig. 20B Prior Art
Figure 21A:
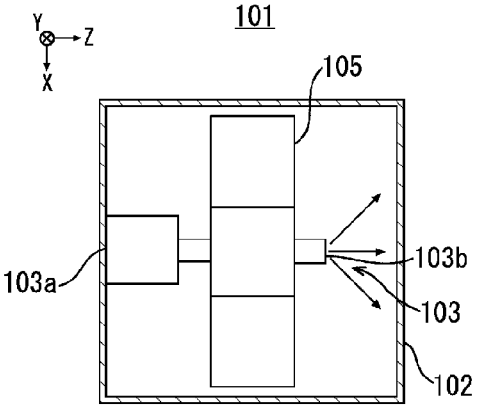
Fig. 21A Prior Art
Figure 21B:
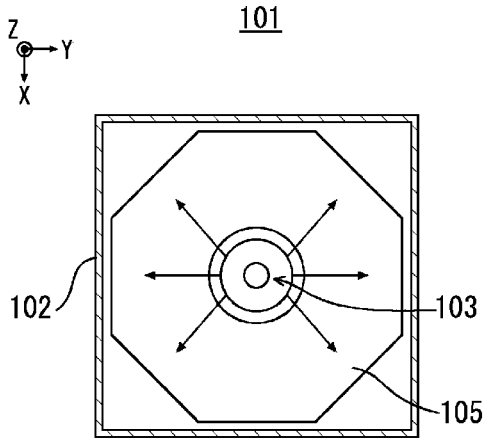
Fig. 21B Prior Art

Furthermore, the multi-mode resonator 1 does not require a dielectric member and the internal space S is filled with air, but as shown in FIG. 17, it is also possible to form the internal space S with a dielectric body S' having high permittivity, such as ceramic. In this case, the exterior conductor 2, the first central conductor 3 and the second central conductor 4 can also be formed by simultaneously depositing films about the periphery of the dielectric body S'. If a dielectric body S' is used, then the wavelength of the electromagnetic field becomes shorter, due to the wavelength shortening effect produced by the high permittivity, and the size of the multi-mode resonator 1 can be made more compact in size. The same also applies to the multi-mode resonator 1' and the multi-mode resonator 5.

EXPLANATIONS OF REFERENCE NUMERALS

1, 1', 5 multi-mode resonator
2, 6 exterior conductor
2*a*, 6*a* first end section of exterior conductor
2*b*, 6*b* second end section of exterior conductor
2*c*, 6*c* circumferential wall section of exterior conductor
3, 7 first central conductor
3*a*, 7*a* one end of first central conductor
3*b*, 7*b* other end of first central conductor
4, 8 second central conductor
4*a*, 8*a* one end of second central conductor
4*b*, 8*b* other end of second central conductor
6*ca* projection on circumferential wall section of exterior conductor
9 lead wire
S internal space
Sg gap between first central conductor and second central conductor

The invention claimed is:

1. A multi-mode resonator in which at least four resonance modes are degenerated, comprising:
a cylindrical-shaped exterior conductor in which both ends of a cylindrical circumferential wall section are closed off by a first end section and a second end section;
a columnar first central conductor disposed inside the exterior conductor, one end of the first central conductor being short circuited to the first end section of the exterior conductor and the other end being left open circuited; and
a columnar second central conductor disposed inside the exterior conductor, one end of the second central conductor being short circuited to the second end section of the exterior conductor, and the other end being left open circuited.

2. The multi-mode resonator according to claim 1, wherein the at least four resonance modes are comprised of:
two TE modes in which an electromagnetic field resonates between the first end section and the second end section of the exterior conductor, with a half wavelength; and
two TEM modes in which an electromagnetic field resonates around the first central conductor and around the second central conductor, with a quarter wavelength.

3. The multi-mode resonator according to claim 2, wherein:
the first central conductor and the second central conductor have lengthwise-direction lengths that are substantially the same;
the first central conductor and the second central conductor are connected by a thin conductive lead wire; and
an inductance component of the lead wire constitutes a parallel resonance circuit with the capacitance between the first central conductor and the second central conductor, and the parallel resonance circuit resonates at the resonance frequency of the two TEM modes.

4. The multi-mode resonator according to claim 1, wherein the exterior conductor includes an interior space which is filled with air.

5. The multi-mode resonator according to claim 1, wherein the first central conductor and the second central conductor have lengthwise-direction lengths that are substantially the same.

6. The multi-mode resonator according to claim 1, wherein the first central conductor and the second central conductor are connected by a thin conductive lead wire.

7. The multi-mode resonator according to claim 1, wherein the exterior conductor includes an interior space which is formed by a dielectric body having high permittivity.

8. The multi-mode resonator according to claim 1, wherein the circumferential wall section of the exterior conductor has an inner wall in which a plurality of projections are formed, the plurality of projections facing towards the center from the inner wall and extending in a lengthwise direction.

9. The multi-mode resonator according to claim 8, wherein the plurality of projections includes four projections.

10. A multi-mode filter, comprising the multi-mode resonator according to claim 1.

11. A wireless communication device, incorporated with the multi-mode filter according to claim 10.

* * * * *